US005224452A

United States Patent [19]

Tomizawa

[11] Patent Number: 5,224,452

[45] Date of Patent: Jul. 6, 1993

[54] AIR-FUEL RATIO CONTROL SYSTEM OF INTERNAL COMBUSTION ENGINE

[75] Inventor: Naoki Tomizawa, Gumma, Japan

[73] Assignee: Japan Electronic Control Systems Co., Ltd., Isezaki, Japan

[21] Appl. No.: 943,826

[22] Filed: Sep. 11, 1992

[30] Foreign Application Priority Data

Sep. 12, 1991 [JP] Japan ..... 3-233133

[51] Int. Cl.[5] ..... F02D 41/04; F02D 41/34

[52] U.S. Cl. ..... 123/436

[58] Field of Search ..... 123/333, 344, 419, 436, 123/443, 478

[56] References Cited

U.S. PATENT DOCUMENTS

| | | | |
|---|---|---|---|
| 4,434,768 | 3/1984 | Ninomiya | 123/436 |
| 4,543,934 | 10/1985 | Morita et al. | 123/436 |
| 4,776,312 | 10/1988 | Yoshioka et al. | 123/436 |
| 5,016,593 | 5/1991 | Takaoka | 123/436 |
| 5,018,498 | 5/1991 | Hoover | 123/436 X |

FOREIGN PATENT DOCUMENTS

| | | | |
|---|---|---|---|
| 3440 | 1/1985 | Japan | 123/436 |
| 125739 | 7/1985 | Japan | 123/436 |

*Primary Examiner*—Willis R. Wolfe

*Attorney, Agent, or Firm*—Foley & Lardner

[57] ABSTRACT

An air-fuel ratio control system of an automotive internal combustion engine comprises a surge detecting device for detecting the surge level of the engine under a lean combustion operation; a lean combustion limit detecting device which issues a first signal when the detected surge level exceeds a given allowable limit and a second signal when the detected surge level fails to exceed the given allowable limit; and an air-fuel mixture diluting device which, when the leans combustion limit detecting device issues the second signal, dilutes the air-fuel mixture in such a manner that a surge level of the engine given by the diluted air-fuel mixture closely approaches the given allowable limit.

9 Claims, 5 Drawing Sheets

AIR-FUEL RATIO CONTROL SYSTEM OF INTERNAL COMBUSTION ENGINE

BACKGROUND OF THE INVENTION

1. Field of the Invention

The present invention relates in general to air-fuel ratio control systems of an internal combustion engine, and more particularly to air-fuel ratio control systems of a type in which the air-fuel mixture fed to the engine can be controlled to a very lean side in accordance with the surrounding conditions.

2. Description of the Prior Art

Hitherto, in order to improve the fuel consumption, a so-called "lean combustion engine" has been proposed in which the combustion of the engine is carried out with a very lean air-fuel mixture, such as a mixture having an air-fuel ratio of about 20 to 25. In the engines of this type, under low speed and low load condition, the engine operates on such a very lean mixture for the improvement of fuel consumption, while upon requirement of quick acceleration and high torque, a somewhat richer-than-normal mixture is fed to the engine. One of the engines of this type is disclosed in Japanese Patent First Provisional Publication No. 1-187338.

However, due to the inherent construction, even the engines of the above-mentioned lean combustion type have a misfire threshold level in the lean combustion side. That is, when the engine is fed with a lean air-fuel mixture exceeding the misfire threshold level, normal operation of the engine is not obtained. Furthermore, even when the lean air-fuel mixture is somewhat richer than the misfire lean level, the surrounding condition of the engine, such as, the nature of fuel, temperature of surrounding air or the like, tends to cause an unstable combustion of the engine.

Accordingly, hitherto, as is seen from the graph of FIG. 6, the actual lean air-fuel ratio has been set to a level which is considerably richer than the misfire threshold level considering the zone inducing the unstable engine combustion. This means that the lean air-fuel ratio set in the engines of the above-mentioned type fails to provide the engine with a satisfied fuel saving or fuel consumption. Furthermore, the enrichment of the lean air-fuel mixture brings about undesired increase of NOx in the exhaust gas.

SUMMARY OF THE INVENTION

It is therefore an object of the present invention to provide an air-fuel ratio control system of internal combustion engine, which is free of the above-mentioned drawbacks.

According to the present invention, there is provided an air-fuel ratio control system of an automotive internal combustion engine which is operated on an air-fuel mixture. The system comprises a surge detecting means for detecting the surge level of the engine under a lean combustion operation; a lean combustion limit detecting means which issues a first signal when the detected surge level exceeds a given allowable limit and a second signal when the detected surge level fails to exceed the given allowable limit; and an air-fuel mixture diluting means which, when the lean combustion limit detecting means issues the second signal, dilutes the air-fuel mixture in such a manner that a surge level of the engine given by the diluted air-fuel mixture closely approaches the given allowable limit.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

Figure 1:
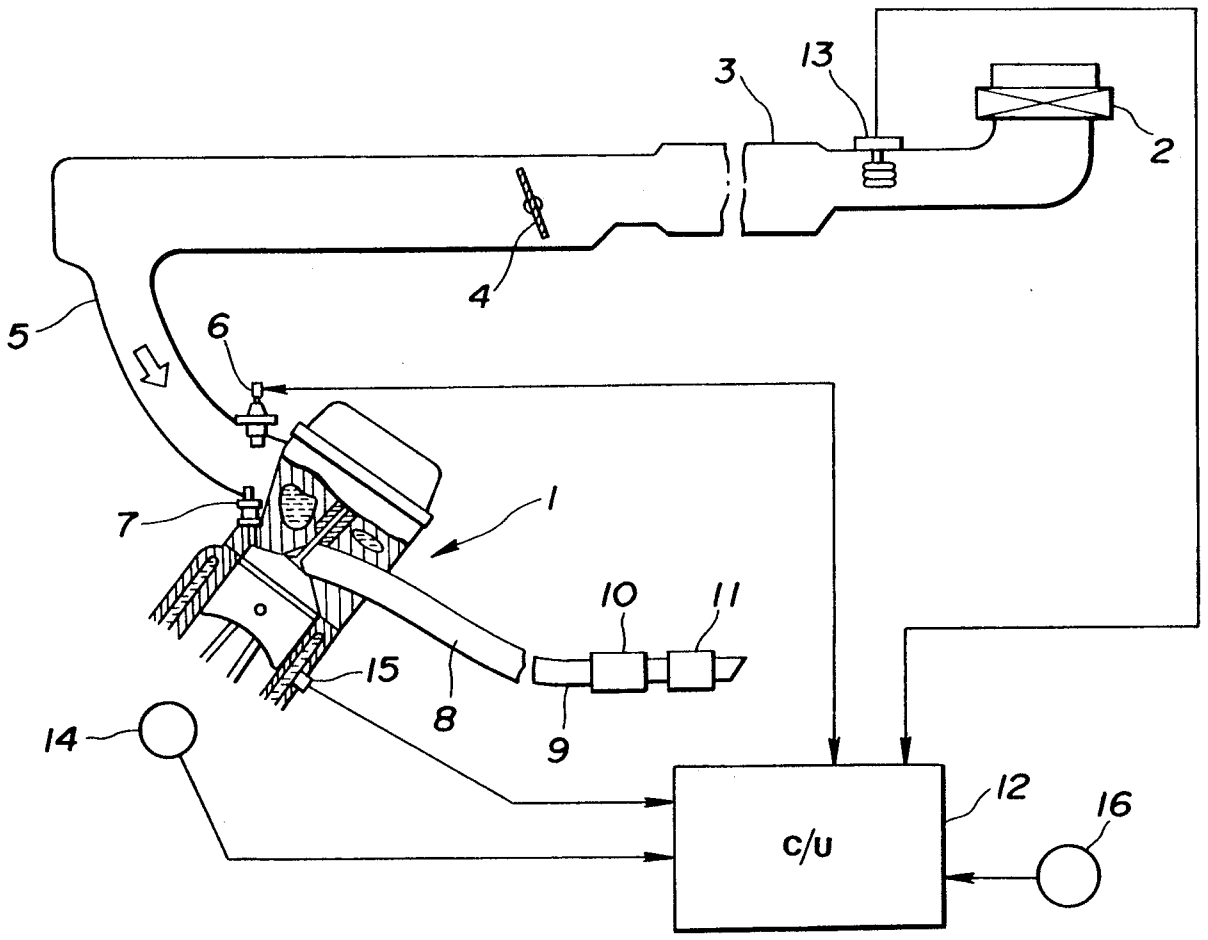
FIG. 1 is a schematic diagram showing the present invention.

Referring to FIG. 1 of the drawings, there is shown an air-fuel ratio control system of the present invention, which is applied to an automotive internal combustion engine 1.

Designated by numeral 2 is an air cleaner from which an intake duct 3 extends to the engine 1 through an intake manifold 5. Designated by numeral 4 is a throttle valve which is installed in a halfway of the intake duct 3. Air cleaned by the air cleaner 2 is thus fed to the engine 1 through the intake duct 3, the throttle valve 4 and the intake manifold 5. The intake manifold 5 has fuel injection valves 6 respectively mounted to branches thereof. The fuel injection valves 6 are of an electromagnetic type in which upon energization (ON operation) or deenergization (OFF operation) of a solenoid, the valve is opened or closed. Each fuel injection valve 6 is controlled in ON-OFF manner by a drive pulse signal issued from a control unit 12 which will be described in detail hereinafter. That is, upon ON operation of the fuel injection valve 6, a given amount of fuel from a fuel pump (not shown) is injected into the corresponding cylinder of the engine 1. The fuel directed to each fuel injection valve 6 is regulated in pressure by a pressure regulator (not shown). That is, in accordance with the drive pulse signal (viz., instruction signal) from the control unit 12, fuel is intermittently supplied to each cylinder by the corresponding fuel injection valve 6 together with the cleaned air.

Combustion chambers defined by the cylinders of the engine 1 are equipped with respective ignition plugs 7. Due to an electric arc produced by the ignition plugs 7, the supplied air-fuel mixture is ignited and combusted. The combusted gas thus produced in the combustion chambers is exhausted into open air through an exhaust manifold 8, an exhaust duct 9, a catalytic converter 10 and a muffler 11.

The control unit 12 is a microcomputer comprising a central processing unit (CPU), a read only memory (ROM), a random access memory (RAM), an analog/digital (A/D) converter and an input/output (I/O) interface. By treating information signals issued from various sensors, the control unit 12 issues instruction pulse signal to control the fuel injection valves 6, which will be described in detail hereinafter.

The sensors include an air-flow meter 13 installed in the intake duct 3, a crankangle sensor 14 installed in a distributor (not shown), a cooling water temperature sensor 15 installed in a water jacket of the engine 1 and a vehicle speed sensor 16. The air0flow meter 13 produces an information signal representative of the amount "Q" of cleaned air directed toward the engine 1. The crankangle sensor 14 outputs both a reference signal (REF signal) in the form of pulse and an angle position signal (POS signal) in the form of pulse train. The reference pulse signal is generated at each reference position in crankangle of each cylinder, for example, at the position of the top dead center (TDC) in each explosion stroke. The angle position pulse signal is generated at intervals of given crankangle, for example, at intervals of 1° or 2° CA (crankangle). It is to be noted that the engine speed "Ne" is derived by measuring the period of the reference pulse signal (REF signal) or counting the number of the angle position pulse signals (POS signals) within a given time. The cooling water temperature sensor 15 detects the temperature "Tw" of cooling water in the water jacket of the engine 1. The vehicle speed sensor 16 may be of a type which derives the vehicle speed from the rotation speed of an output shaft of a transmission (not shown). That is, the vehicle speed sensor 16 may be of a type which issues a given number of pulses each time the output shaft of the transmission makes one revolution.

Figure 2:
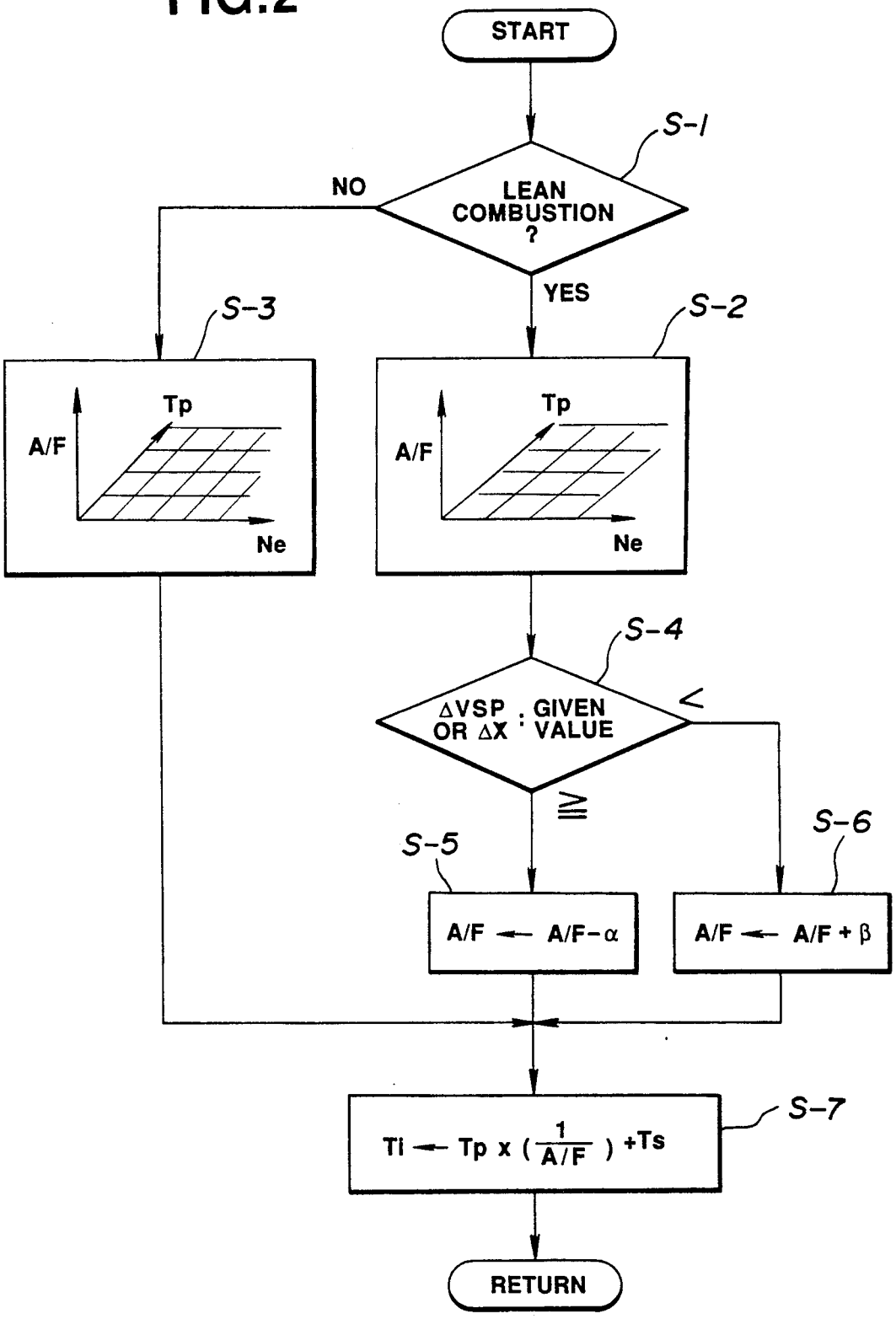
FIG. 2 is a flowchart showing operation steps conducted in the system for effecting a fuel control.
Figure 3:
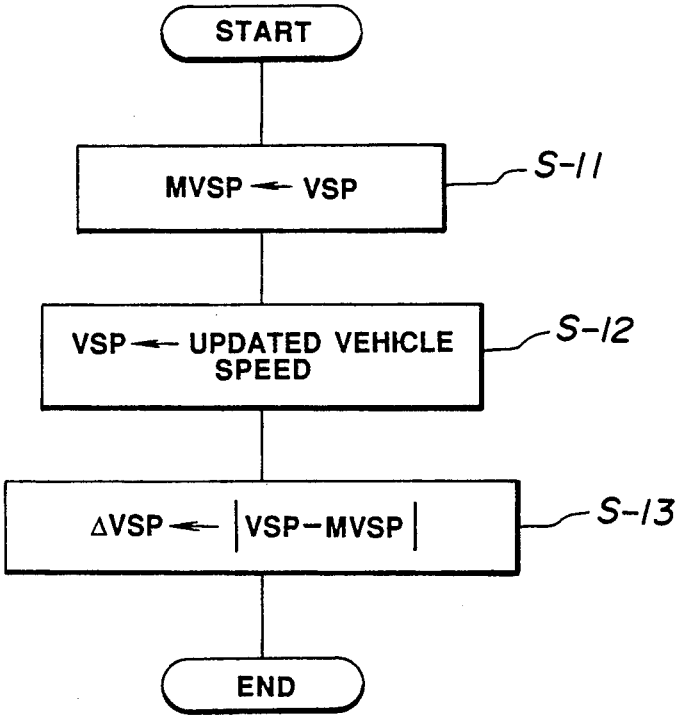
FIG. 3 is a flowchart showing operation steps conducted in the system for detecting a fluctuation of vehicle speed.
Figure 4:
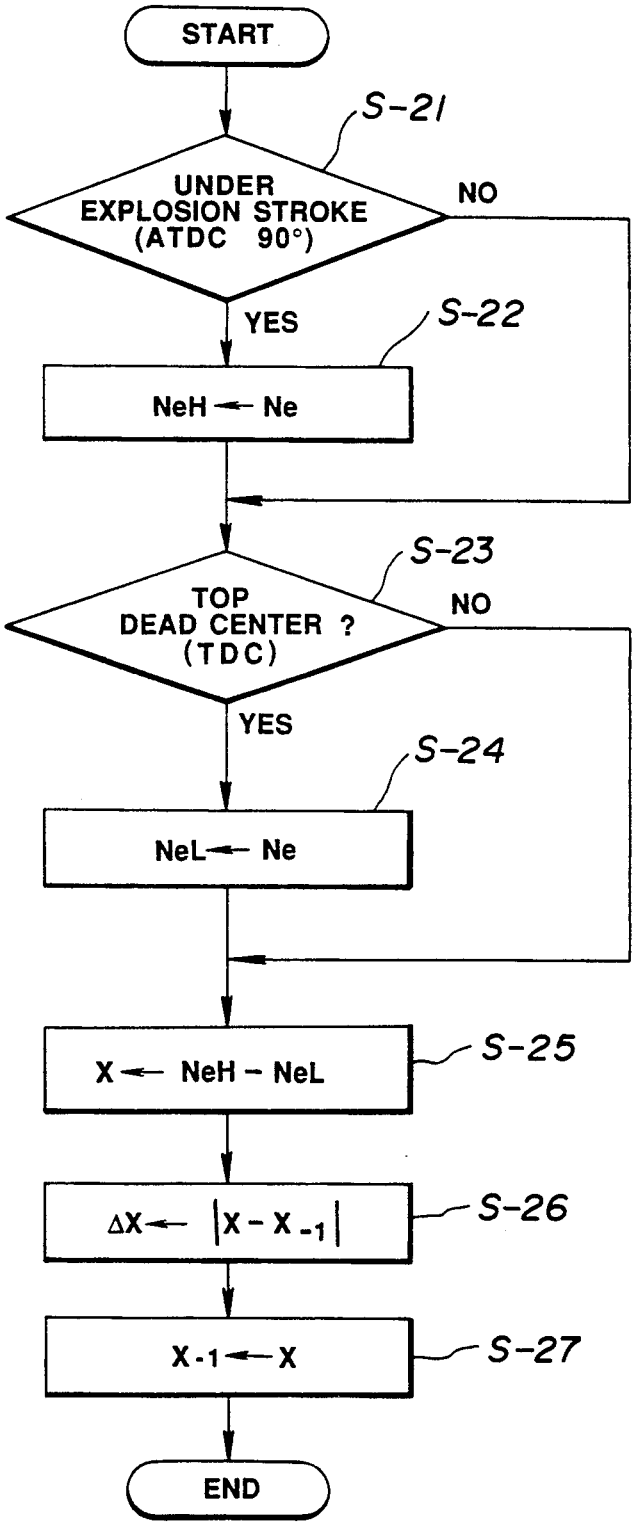
FIG. 4 is a flowchart showing operation steps conducted in the system for detecting a fluctuation of a pulsation width of engine speed.

The CPU of the microcomputer in the control unit 12 processes various data in line with programs stored in the ROM, the programs being shown by the flowcharts of FIGS. 2 to 4.

As will become apparent as the description proceeds, a surge detecting means, a lean combustion threshold detecting means and an air-fuel ratio leaning means are possessed by the computer of the control unit 12.

First, the flowchart of FIG. 2 will be described, which is a program for calculating a fuel injection amount "Ti" which corresponds to a pulse width of a drive pulse signal applied to each fuel injection valve 6. This program is carried out at intervals of a given small period.

At step 1 (S-1), a judgement is made as to whether a lean combustion operation condition is established or not. The lean combustion operation condition is the condition in which the fuel injection amount "Ti" can be calculated based on a given lean air-fuel ratio (for example, 20 to 25) which is larger (or leaner) than the stoichiometric value (viz., 14.7). In the present invention, there are two given combustion areas of air-fuel ratio, one being a lean combustion area wherein the combustion is carried out with a lean air-fuel ratio (for example, 20 to 25) and the other being a somewhat richer combustion area (or normal combustion area) wherein the combustion is carried out with a stoichiometric air-fuel ratio (14.7) or an air-fuel ratio (for example, 13) somewhat richer than the stoichiometric ratio. The lean combustion area is practically used in an engine condition wherein the engine is under a low load and low engine speed. Such engine condition is sensed by, for example, the engine speed "Ne" and a basic fuel injection amount "Tp". In fact, the basic fuel injection amount "Tp" represents the engine load. As is described hereinafore, in the lean combustion area, the fuel injection amount "Ti" is calculated based on the given lean air-fuel ratio which is much leaner than the stoichiometric value, for the purpose of improving the fuel consumption. While, in the somewhat richer combustion area, the fuel injection amount is calculated based on the stoichiometric air-fuel ratio (14.7) or an air-fuel ratio somewhat richer than the stoichiometric value, for the purpose of increasing the engine torque.

However, as will be described in detail hereinafter, in the present invention, the air-fuel ratio in the lean and somewhat richer combustion areas is finely controlled in accordance with the operation condition of the engine. That is, in the present invention, the combustion is carried out with an appropriate air-fuel ratio in every operation condition of the engine.

When, at step 1 (S-1), the judgement is so made that the lean combustion operation condition is established, step 2 (S-2) is taken. At this new step, a lean air-fuel ratio appropriate for the existing operating condition of the engine is looked up from a stored lean combustion map (viz., a lean air-fuel ratio allocation map) in which the air-fuel ratios (for example, 20 to 25) for the lean combustion area are plotted in accordance with both the engine speed "Ne" and the basic fuel injection amount "Tp".

While, when, at step 1 (S-1), the judgement is so made that the lean combustion operation condition is not established, step 3 (S-3) is taken. At this step, a somewhat richer air-fuel ratio appropriate for the existing operating condition of the engine is looked up from a stored richer combustion map (viz., a richer air-fuel ratio allocation map) in which the air-fuel ratios (for example, 13 to 14.7) for somewhat the richer combustion area are plotted in accordance with both the engine speed "Ne" and the basic fuel injection amount "Tp".

When the somewhat richer air-fuel ratio is set in the step 3 (S-3), step 7 (S-7) is then taken. At this step, the following calculations are executed for obtaining an appropriate fuel injection amount "Ti".

$$Ti \leftarrow Tp \times (1/(A/F)) + Ts \quad (1)$$

wherein:

Ti: appropriate fuel injection amount,

Tp: basic fuel injection amount,

A/F: value looked up from somewhat richer combustion map, and

Ts: factor compensating the fluctuation of effective open period of fuel injection valve caused by voltage fluctuation.

$$Tp \leftarrow (Q/Ne) \times K \quad (2)$$

wherein:

Q: amount of air,

Ne: engine speed, and

K: factor provided by characteristic of fuel injection valve.

It is to be noted that the basic fuel injection amount "Tp" is based on the following equation.

$$A/F = 1 \quad (3)$$

If desired, the appropriate fuel injection amount "Ti" may be provided by considering a correction factor based on the cooling water temperature "Tw". Upon a given fuel injection time, the control unit 12 issues to each fuel injection valve 6 a drive signal whose pulse width corresponds to the updated value of "Ti".

While, after the lean air-fuel ratio is looked up from the stored lean combustion map at step 2 (S-2), a correction treatment for the air-fuel ratio is carried out at steps 4, 5 and 6 (S-4, S-5 and S-6) before taking the step 7 (S-7). That is, after step 2 (S-2), step 4 (S-4) is taken. At this step, a judgement is made as to whether a parameter "ΔVSP" or "Δx" is greater than a predetermined value or not. The parameter "ΔVSP" or "Δx" represents the surge level of the engine 1 and is provided from operation steps shown in the flowchart of FIG. 3 or FIG. 4.

The predetermined value represents the allowable limit of the surge level, and thus, when the parameter "ΔVSP" or "Δx" exceeds the predetermined value, it can be judged or assumed that the surge of the engine 1 exceeds the allowable limit. Thus, when the parameter "ΔVSP" or "Δx" exceeds the predetermined value, step 5 (S-5) is taken for lowering the surge level by stabilizing the engine combustion. At this step 5 (S-5), a given value "$\alpha$" is subtracted from the lean air-fuel ratio obtained at step 2 (S-2) to provide a corrected lean air-fuel ratio. The lean combustion map is updated with reference to this corrected lean air-fuel ratio. That is, in the step 5 (S-5), the following calculation is executed.

$$A/F \leftarrow A/F - \alpha \quad (4)$$

While, when the parameter "ΔVSP" or "Δx" is smaller than the predetermined value, it can be judged or assumed that the surge level of the engine 1 does not exceed the allowable limit, which means that much leaner combustion is available in the engine 1. Thus, step 6 (S-6) is taken for correcting the lean air-fuel ratio to a much leaner air-fuel ratio. That is, at this step 6 (S-6), a given value "$\beta$" is added to the lean air-fuel ratio obtained at step 2 (S-2) to provide a corrected or much leaner air-fuel ratio. The lean combustion map is updated with reference to this corrected much leaner air-fuel ratio. That is, in the step 6 (S-6), the following calculation is executed.

$$A/F \leftarrow A/F + \beta \quad (5)$$

It is to be noted that the initial lean air-fuel ratio of the lean combustion map (viz., step 2) is so set that the surge level thus provided by the lean air-fuel ratio in each operation condition becomes smaller than the allowable limit. That is, the intitial lean air-fuel ratio has been set to a somewhat richer side of the allowable limit of the serge level, so that even when various factors, such as nature of fuel, temperature of intake air and the like change, the surge level never exceeds the allowable limit. In fact, such factors have a certain effect on the surge of the engine under the lean combustion operation.

Thus, in the above-mentioned condition, much leaner combustion is available in the engine 1 without occurrence of the undesired surge. That is, by comparing the parameter "ΔVSP" or "Δx" which represents the surge level with the predetermined level which represents the allowable limit of the surge level, an actual threshold level of the lean combustion is detected, and the lean combustion is carried out with the surge level closely approaching the allowable limit. Thus, even when the lean combustion limit is changed due to change of the factors, much leaner combustion is available dealing with the change of the limit. Accordingly, improvement in fuel consumption as well as reduction of NOx in the exhaust gas are available.

The parameters "ΔVSP" and "Δx" which represent the surge level will be described with reference to the flowcharts of FIGS. 3 and 4.

The flowchart of FIG. 3 represents the operation steps for obtaining the parameter "ΔVSP". These steps are executed each time the pulse signal from the vehicle speed sensor 16 is applied. The vehicle speed sensor 16 issues a given number of pulses each time the transmission output shaft makes one revolution. Thus, the vehicle speed "VSP" is obtained by measuring the period of the pulse signal.

At step 11 (S-11), the vehicle speed "VSP" which has been used in the last execution of the main program is set as a previous value "MVSP". Then, at step 12 (S-12), the newest vehicle speed which is obtained by the newest measurement of the pulse signal period is set as a new value "VSP". Then, at step 13 (S-13), the following calculation is executed.

$$\Delta VSP \leftarrow |VSP - MVSP| \quad (6)$$

It is to be noted that the "ΔVSP" is used for detecting a small fluctuation of the vehicle speed caused by the surge. Thus, when the "ΔVSP" is greater than the predetermined value, it can be judged that the lean combustion is being carried out with the lean air-fuel ratio exceeding the allowable limit and thus the engine combustion is unstable causing occurrence of the undesired surge.

The flowchart of FIG. 4 represents the operation steps for obtaining the parameter "Δx" which has a mutual relation with the fluctuation of the engine output. In case wherein the engine 1 is of four cylinder type, these steps are executed at the positions of TDC (top dead center) and ATDC (after top dead center) 90° CA (crankangle) in accordance with the signal from the crankangle sensor 14.

Figure 5:
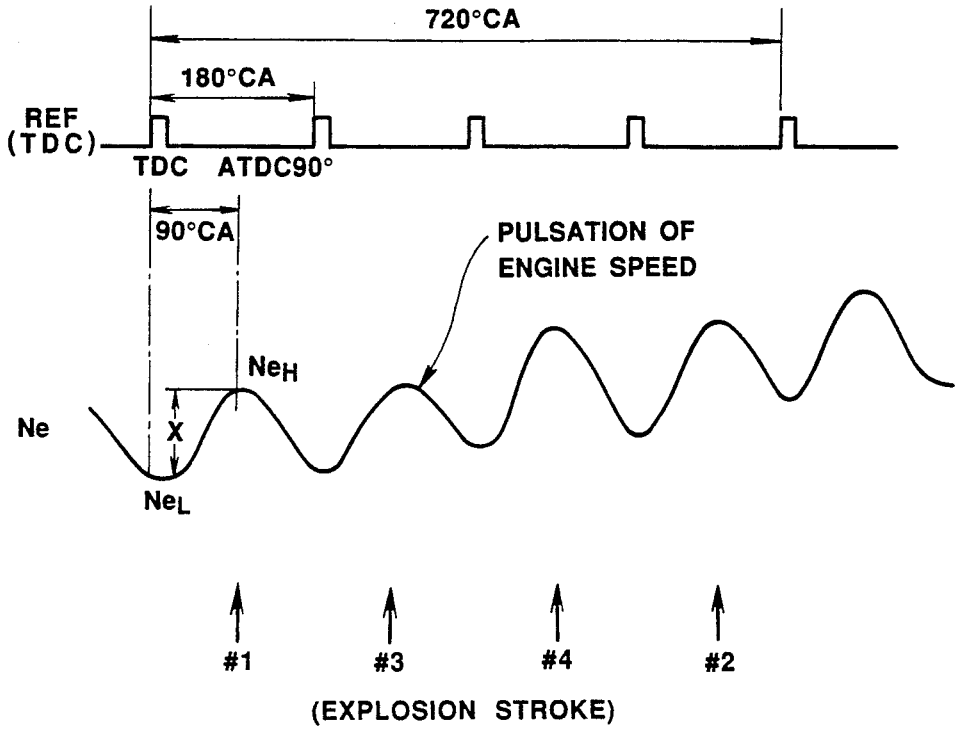
FIG. 5 is a time chart showing the pulsation of the engine speed (Ne) with respect to the explosion stroke of each cylinder.
Figure 6:
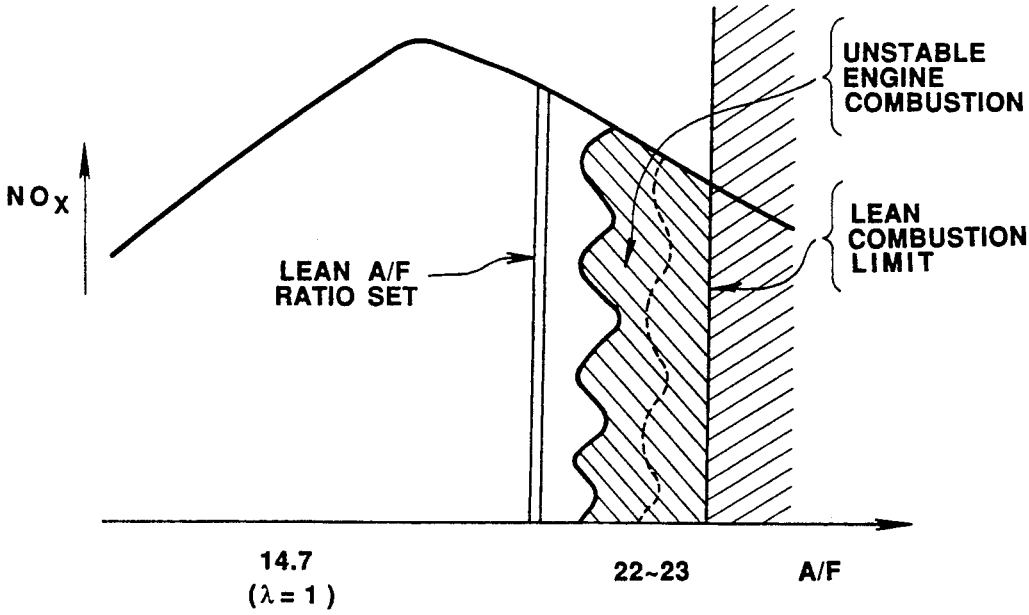
FIG. 6 is a graph showing the manner for setting a lean air-fuel ratio in a conventional lean combustion engine.

In the four cylinder engine 1, assuming that the firing order is #1-#3-#4-#2, the peak of the engine speed "Ne" caused by the explosion stroke of each cylinder appears between adjacent two TDC positions, as is seen from the time chart of FIG. 5, so that the engine speed "Ne" at one TDC position corresponding to the top dead center of a compression stroke of another cylinder becomes small. Thus, the pulsation width "x" of the engine speed "Ne" caused by the explosion stroke of each cylinder has a mutual relation with the output of the engine 1, and thus the fluctuation rate "Δx" of the pulsation width "x" represents the fluctuation of the engine output, that is, the surge level of the surge level.

At step 21 (S-21), a judgement is made as to whether the engine is under an explosion stroke or not, that is, whether the crankangle shows the ATDC 90° CA or not. This is intended for detecting a peak level "NeH" of the pulsation of the engine speed "Ne" caused by the explosion stroke. When the ATDC 90° CA is judged, step 22 (S-22) is taken. At this step, the updated engine speed "Ne" is set to the peak level "NeH". Then, step 23 (S-23) is taken. At this step, a judgement is carried out as to whether or not the top dead center (TDC) is the position where a trough level "NeL" of the pulsation of the engine speed "Ne" caused by the explosion stroke appears. When such TDC is judged, step 24 (S-24) is taken. At this step, the updated engine speed "Ne" is set to the trough level "NeL". Then, step 25 (S-25) is taken. At this step, the following calculation is executed.

$$x \leftarrow NeH - NeL \quad (7)$$

Then, step 26 (S-26) is taken to execute the following calculation.

$$\Delta x \leftarrow |x - x - 1| \quad (8)$$

x − 1: value which has been used in the last execution of the main program.

Then, step 27 is taken. At this step, the "x" thus obtained at step 26 is set as a previous value "x − 1" which is used in a subsequent execution of the main program.

The value "x" increases as the engine output increases, and thus when the engine output is constant, the value "x" is kept constant. Thus, when the value "x" makes a large fluctuation every 90° CA, it can be assumed that a surge of the engine takes place. Accordingly, when, at the step 4 (S-4) of the flowchart of FIG. 2, the judgement is so made that the value "Δx" is greater than the predetermined value, it can be assumed that undesired surge occurs due to the lean combustion exceeding the allowable limit.

As is described hereinabove, in the present invention, by detecting the lean combustion limit which changes in accordance with the surrounding condition of the engine, much leaner combustion is carried out while controlling the surge within the allowable level. Thus, in accordance with the present invention, improvement in fuel consumption by effecting such much leaner combustion as well as reduction in NOx in exhaust gas are both achieved.

What is claimed is:

1. An air-fuel ratio control system of an automotive internal combustion engine which is operated on an air-fuel mixture, comprising:

a surge detecting means for detecting the surge level of the engine under a lean combustion operation;

a lean combustion limit detecting means which issues a first signal when the detected surge level exceeds a given allowable limit and a second signal when the detected surge level fails to exceed said given allowable limit; and an air-fuel mixture diluting means which, when said lean combustion limit detecting means issues said second signal, dilutes the air-fuel mixture in such a manner that a surge level of the engine given by the diluted air-fuel mixture closely approaches said given allowable limit.

2. An air-fuel ratio control system as claimed in claim 1, in which said surge detecting means comprises:

first means for preparing a third signal which represents the existing vehicle speed;

second means for preparing a fourth signal which represents the last vehicle speed; and third means for measuring the absolute value of a difference between said third and fourth signals.

3. An air-fuel ratio control system as claimed in claim 2, in which said lean combustion limit detecting means comprises:

fifth means for comparing said absolute value of the difference with a predetermined value, said predetermined value representing the given allowable limit of the surge level.

4. An air-fuel ratio control system as claimed in claim 3, in which said air-fuel mixture diluting means comprises:

sixth means for correcting the air-fuel ratio of the air-fuel mixture to a much leaner value when said fifth means detects that said absolute value of the difference is smaller than said predetermined value.

5. An air-fuel ratio control system as claimed in claim 4, in which said air-fuel mixture diluting means further comprises:

seventh means for correcting the air-fuel ratio of the air-fuel mixture to a somewhat richer value when said fifth means detects that said absolute value of the difference is larger than said predetermined value.

6. An air-fuel ratio control system as claimed in claim 1, in which said surge detecting means comprises:

eighth means for detecting a peak level of a pulsation of the engine speed;

ninth means for detecting a trough level of the pulsation of the engine speed;

tenth means for measuring a first difference between said peak level and said trough level; and eleventh means for measuring the absolute value of a second difference between said first difference and a previously set difference, said previously set difference being the difference which has been previously measured.

7. An air-fuel ratio control system as claimed in claim 6, in which said lean combustion limit detecting means comprises:

twelfth means for comparing said absolute value of the second difference with a predetermined value, said predetermined value representing the given allowable limit of the surge level.

8. An air-fuel ratio control system as claimed in claim 7, in which said air-fuel mixture diluting means comprises:

thirteenth means for correcting the air-fuel ratio of the air-fuel mixture to a much leaner value when said twelfth means detects that said absolute value of the second difference is smaller than said predetermined value.

9. An air-fuel ratio control system as claimed in claim 8, in which said air-fuel mixture diluting means further comprises:

fourteenth means for correcting the air-fuel ratio of the air-fuel mixture to a somewhat richer value when said twelfth means detects that said absolute value of the second difference is larger than said predetermined value.

* * * * *